US006981393B2

(12) United States Patent
Ikoma

(10) Patent No.: US 6,981,393 B2
(45) Date of Patent: Jan. 3, 2006

(54) YARN FEEDERS OF FLAT KNITTING MACHINE

(75) Inventor: Kenji Ikoma, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/472,521

(22) PCT Filed: Mar. 15, 2002

(86) PCT No.: PCT/JP02/02524

§ 371 (c)(1),
(2), (4) Date: Sep. 24, 2003

(87) PCT Pub. No.: WO02/079556

PCT Pub. Date: Oct. 10, 2002

(65) Prior Publication Data

US 2004/0159126 A1 Aug. 19, 2004

(30) Foreign Application Priority Data

Mar. 29, 2001 (JP) ..... 2001-095949

(51) Int. Cl.
*D04B 15/52* (2006.01)

(52) U.S. Cl. ..... 66/126 A

(58) Field of Classification Search ..... 66/126 A, 66/126 R, 127, 128, 129, 133, 64, 214, 125 R
See application file for complete search history.

(56) References Cited

U.S. PATENT DOCUMENTS 4,052,865 A * 10/1977 Zamarco ..... 66/128
4,738,124 A 4/1988 Stoll et al.
5,031,423 A * 7/1991 Ikenaga ..... 66/126 R
5,109,681 A * 5/1992 Schmid et al. ..... 66/126 R
5,345,789 A 9/1994 Yabuta
6,021,651 A 2/2000 Shima

FOREIGN PATENT DOCUMENTS

| | | |
|---|---|---|
| DE | 27 30 306 | 1/1979 |
| EP | 0 572 360 | 12/1993 |
| JP | 61-51061 | 11/1986 |
| JP | 8-13295 | 1/1996 |
| WO | 94/01606 | 1/1994 |

* cited by examiner

*Primary Examiner*—Danny Worrell
(74) *Attorney, Agent, or Firm*—Wenderoth, Lind & Ponack, L.L.P.

(57) ABSTRACT

Yarn feeders are arranged such that feeder case portions are slidably engaged with a knitting yarn guide rail disposed on an upper portion of needle beds, and can be selectively brought by a bringing device. Each of the feeder cases is provided with a switching mechanism for switching a yarn feeding port to a feeding position and a waiting position by swinging the port. The switching mechanism is operated at a time during which a yarn feeder selected by the bringing device is brought from a stop state in order to feed yarn. The yarn feeding port is switched from the waiting position to the feeding position, a swinging direction of the yarn feeding port to the waiting position, after it feeds yarn, is set, and the yarn feeding port can be switched from the feeding position to the waiting position in association with a selection cancel operation of the bringing device after the yarn is fed.

2 Claims, 11 Drawing Sheets

YARN FEEDERS OF FLAT KNITTING MACHINE

TECHNICAL FIELD

The present invention relates to yarn feeders for a flat knitting machine, and more particularly to yarn feeders used to knit an intersia pattern.

BACKGROUND ART

A fabric having an intersia pattern can be formed by knitting the fabric with different yarns by switching several yarn feeders, when one course is knitted, without separating the fabric.

When the fabric having the intarsia pattern is knitted, as shown in FIG. 11, plural yarn feeders 12*a* and 12*b* are slidably disposed on a knitting yarn guide rail. The yarn feeder 12*a* feeds yarn to a first knitting region A, the yarn feeder 12*b* feeds yarn to a second knitting region B, and the yarn feeder 12*a* is replaced with the yarn feeder 12*b* at respective yarn changing point. However, when the yarn feeder 12*a* has fed yarn to a leftmost knitting needle of knitting needles for knitting in knitting region A from a right side, the yarn feeder 12*a* has already passed through a point P1 and is positioned leftward thereof.

Accordingly, when the yarn feeder 12*a* is at this position, a problem occurs in that knitting yarn extending in an obliquely lower right direction from the yarn feeder 12*a* is erroneously fed to a knitting needle for knitting in next knitting region B.

To eliminate this problem, a yarn feeder disclosed in Japanese Examined Patent Publication No. 61-51061 has been proposed.

In the yarn feeder of this publication, of yarn feeders stopped on a knitting yarn guide rail by a brake unit, a yarn feeding port of a yarn feeder selected by a bringing device is first moved from a waiting position to a feeding position approaching knitting needles by sliding the bringing device, and then a braking force is released.

When the bringing device subsequently slides, the yarn feeder is brought thereby and feeds yarn to a predetermined knitting needle so that a predetermined region is knitted therewith. Then, the yarn feeder is released from the bringing device and stopped by the brake unit.

When the yarn feeder further slides in a state that the yarn feeder is stopped by the brake unit, the yarn feeding port of the yarn feeder is switched from the feeding position to a waiting position that is moved inward of a knitted region from the feeding position to prevent a problem of a knitting needle in an adjacent knitting region being erroneously fed with yarn.

In the yarn feeder of this proposal, however, a series of operations for switching the yarn feeding port of the yarn feeder from the waiting position to the feeding position, releasing a braking force, bringing the yarn feeder, and switching the yarn feeding port of the yarn feeder from the feeding position to the waiting position, inward of a knitted fabric region, from the feeding position is executed while the yarn feeder travels from a time before it is brought to a time after it is brought. Accordingly, a sliding distance of the bringing device, which is required to execute the above operations, is increased, and hence a size of the yarn feeder is increased at a portion thereof operated by the bringing device. This problem of an increase in size of the yarn feeder also occurs in a yarn feeder disclosed in, for example, Japanese Examined Patent Application Publication No. 3-23662 and the like.

When the size of the yarn feeder is increased, a weight thereof is increased, and a shock, which is generated when, for example, the bringing device brings the yarn feeder at a high speed, is increased, which makes it necessary to reinforce an apparatus in its entirety.

An object of the present invention, which was proposed in view of the above problems, is to provide yarn feeders for a flat knitting machine capable of switching a yarn feeding port from a feeding position to a waiting position in a short traveling distance of a bringing device without increasing a size of a portion selected and brought by the bringing device. In a time during which the yarn feeder selected by the bringing means is brought from a stop state, the yarn feeder port is switched from the waiting position outside the knitting area to the feeding position as well as the yarn feeder port after the selection is cancelled is switched to swing toward out side of the knitting area.

SUMMARY OF THE INVENTION

To achieve the above object, yarn feeders for a flat sewing machine according to the present invention are characterized by being arranged such that feeder case portions are slidably engaged with a knitting yarn guide rail disposed at an upper portion of needle beds and can be selectively brought by a bringing device. Each feeder case is provided with a yarn feeding position and two waiting positions, i.e. a first waiting position and a second waiting position across the yarn feeding position for a yarn feeding port and with a switching mechanism for switching a yarn feeding port to the feeding position and the first and second waiting positions by swinging the yarn feeding port, characterized in that, of the two waiting positions of the yarn feeding port, the waiting position, which is located on an upper side relative to the feeding position of the sliding path of the bringing device along which the bringing device slides for feeding yarn, is set as the second waiting position, the other waiting position located across the feeding position is set as the first waiting position, the switching mechanism switches the yarn feeding port from the first waiting position to the feeding position at a time during which a yarn feeder selected by the bringing means starts to be brought from a stop state, sets a swinging direction such that the yarn feeding port is swung from the feeding position to the second waiting position after it feeds the yarn, and can switch the yarn feeding port from the feeding position to the second waiting position in association with a selection cancel operation of the yarn feeder executed by the bringing device after the yarn is fed.

Next, yarn feeders for a flat knitting machine according to the present invention are characterized by being arranged such that feeder rods are swingably and upward/downward movably supported by feeder cases at intermediate portions thereof, yarn feeding ports are formed at lower ends of the feeder rods, swingably operating portions are formed on the intermediate portions of the feeder rods, push-down operation portions for moving yarn feeder portions downward to a feeding position against upward urging forces are formed at upper ends of the feeder rods, setting units for setting a direction in which the swingably operating portions are moved upward and returned are provided, and switching mechanisms are arranged such that when the feeder rods are moved downward to position the yarn feeding ports at a feeding position, the upward-moving and returning direction of the swingably operating portions are switched by the setting units.

Further, one of the features of the yarn feeders for a flat knitting machine according to the present invention resides in that the waiting positions of the yarn feeding ports are set on upper sides of the yarn feeding positions in the sliding path of the bringing device along which the bringing device slides for feeding yarn, and the feeding positions are set at positions nearer to the knitting needles than are the waiting positions of the yarn feeding ports.

DETAILED DESCRIPTION OF THE PREFERRED EMBODIMENTS

An embodiment of a yarn feeder of a flat knitting machine of the present invention will be explained below based on the drawings.

Figure 1:
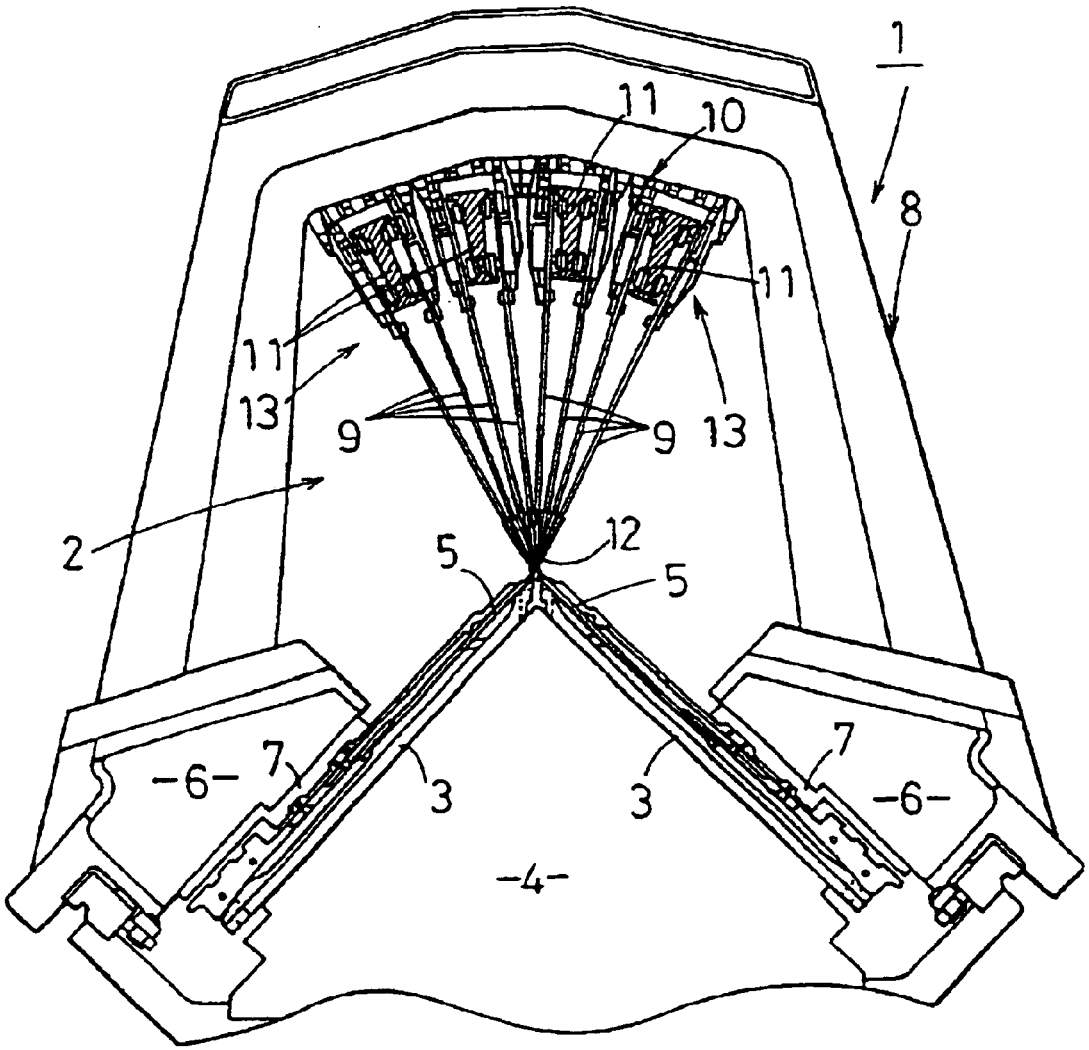
FIG. 1 is a side elevational view of a flat knitting machine having a yarn feeding apparatus including yarn feeders of the present invention.

FIG. 1 is a side elevational view of a flat knitting machine having a yarn feeding apparatus including yarn feeders of the present invention, wherein reference numeral 1 denotes the flat knitting machine in its entirety, and 2 denotes the yarn feeding apparatus.

The flat knitting machine 1 has a pair of (front and back) needle beds 3 disposed on a frame 4 in a fan shape with extreme ends thereof confronting each other, and each needle bed 3 has plural knitting needles 5 disposed thereon in parallel with each other so that they are movable back and forth.

A carriage 6 is disposed on an upper surface of each needle bed 3 so that it can be caused to reciprocatingly travel by a belt drive device (not shown), and the knitting needles 5 are advanced and retreated by a knitting cam 7 attached to the carriages 6.

A gate arm 8 is disposed on the carriages 6 so as to stride over the front and back needle beds 3, and is integrally coupled with the carriages 6. Bringing device 10, which brings yarn feeders 9, and push-down device 13, which pushes down weft yarn ports 12 of the yarn feeders 9 to positions near to an extreme end of the knitting needles 5, 5, are mounted on the gate arm 8.

Four knitting yarn guide rails 11 are disposed on an upper portion of the needle beds 3 along a longitudinal direction thereof in a fan shape in a front and back direction of the needle beds 3 near the vicinity of the extreme ends of the knitting needles 5 disposed in parallel with each other on the needle beds 3.

The bringing device 10 is arranged approximately similarly to that disclosed in Japanese Patent No. 3044370.

Figure 2:
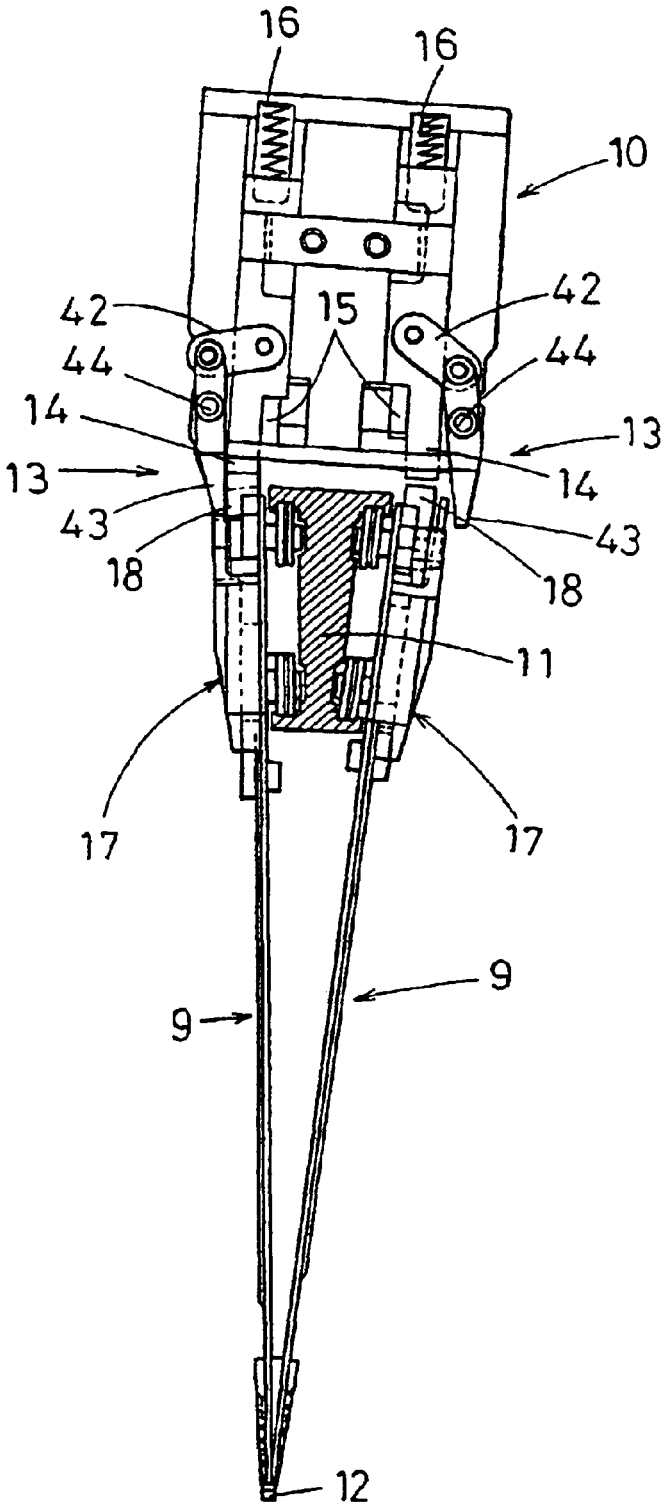
FIG. 2 is an enlarged view of a yarn feeding portion of the present invention.

That is, each bringing device 10 includes transmission rods 15 for transmitting movement of output shafts of solenoids, which are projected and retracted in response to a signal output from a controller (not shown), to bringing pins 14 as shown in FIG. 2. The bringing pins 14 are urged downward by springs 16 so that they bring the yarn feeders 9 by being engaged with engaging portions 19 formed on a pair of right and left swinging pieces 18 disposed on feeder cases 17 of the yarn feeders 9 at portions near centers of upper ends thereof (refer to FIG. 3).

Each yarn feeder 9 includes feeder case 17 slidably supported by a knitting yarn guide rail 11, a feeder rod 20 having a yarn feeding port 12 at a lower end thereof, and a feeder rod guide 21 for guiding the feeder rod 20 upwardly and downwardly, with the feeder rod 20 and the feeder rod guide 21 being formed by hanging down from the feeder case 17. The feeder rod guide 21 is swingably pivoted to the feeder case 17 at a pivot portion located near an upper portion of the feeder rod guide.

The feeder rod 20 is formed of a slender sheet-shaped lower plate 22 whose right and left side edge portions are supported by the feeder rod guide 21 so that it is slidably moved upward and downward, an intermediate plate 23 whose lower end portion is coupled with an upper end portion of the lower plate 22, and an upper plate 25 whose lower end portion is coupled with an upper end portion of the intermediate plate 23 through a push-down roller 24 projecting from an upper back surface of the intermediate plate 23 and being engaged with a lateral slot 26 formed at a lower end portion thereof.

Coil springs 27 are mounted in an intermediate portion of the upper plate 25 between it and spring receiving portions 28 of the feeder case 17 in order to urge the yarn feeding port 12 upward through the intermediate plate 23 and the lower plate 22.

Further, a switching roller 30 of a switching mechanism 29, which switches an attitude of the yarn feeding port 12, projects from a front surface of the intermediate plate 23 at an upper end portion thereof.

The switching mechanism 29 includes the switching roller 30, a regulation hole 31 formed through the feeder case 17 for regulating a swinging motion of the switching roller 30, and a selection lever 32 disposed on a back surface side of the regulation hole 31.

Figure 3:
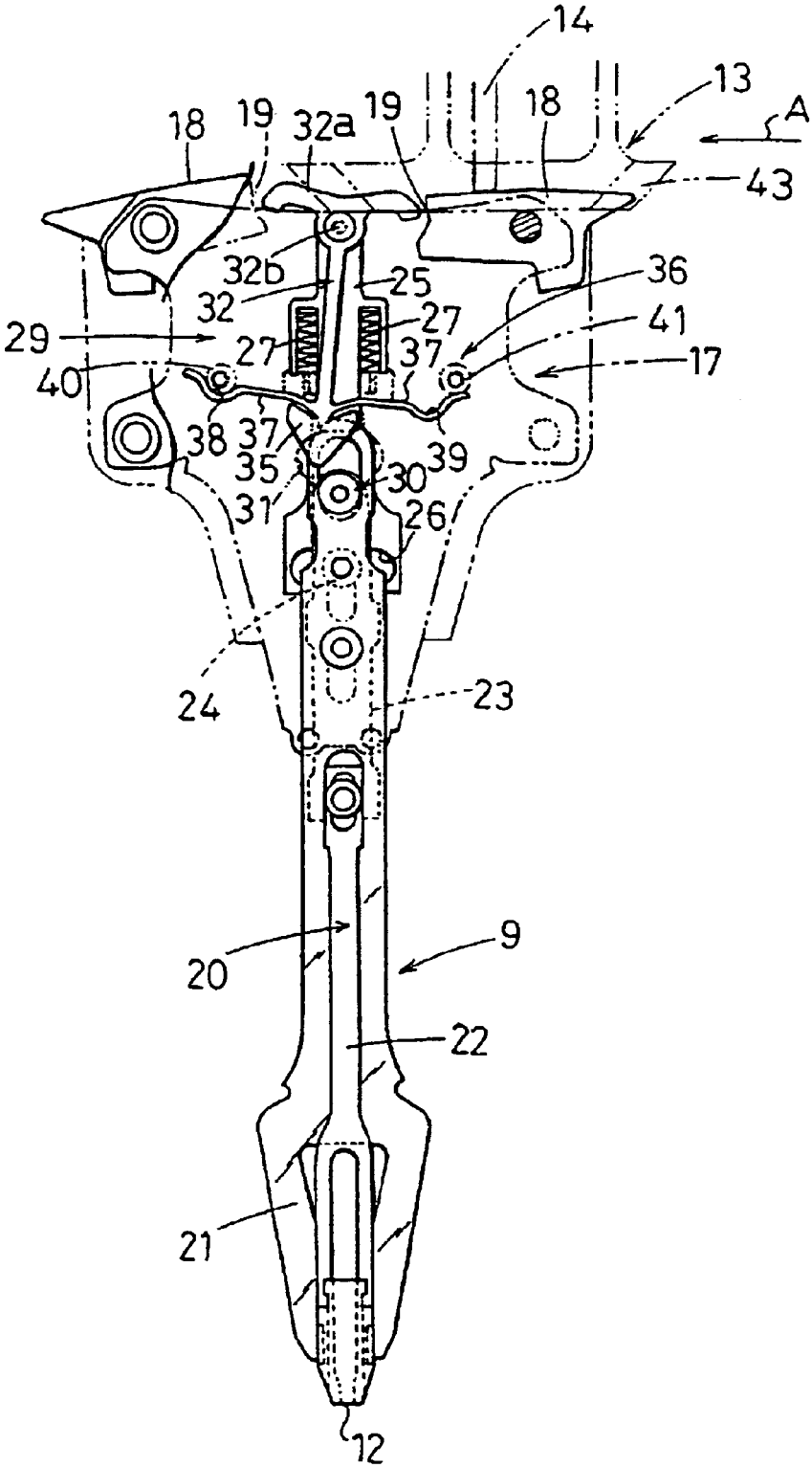
FIG. 3 is a view explaining a mechanism of the yarn feeder portion of the present invention.
Figure 4:
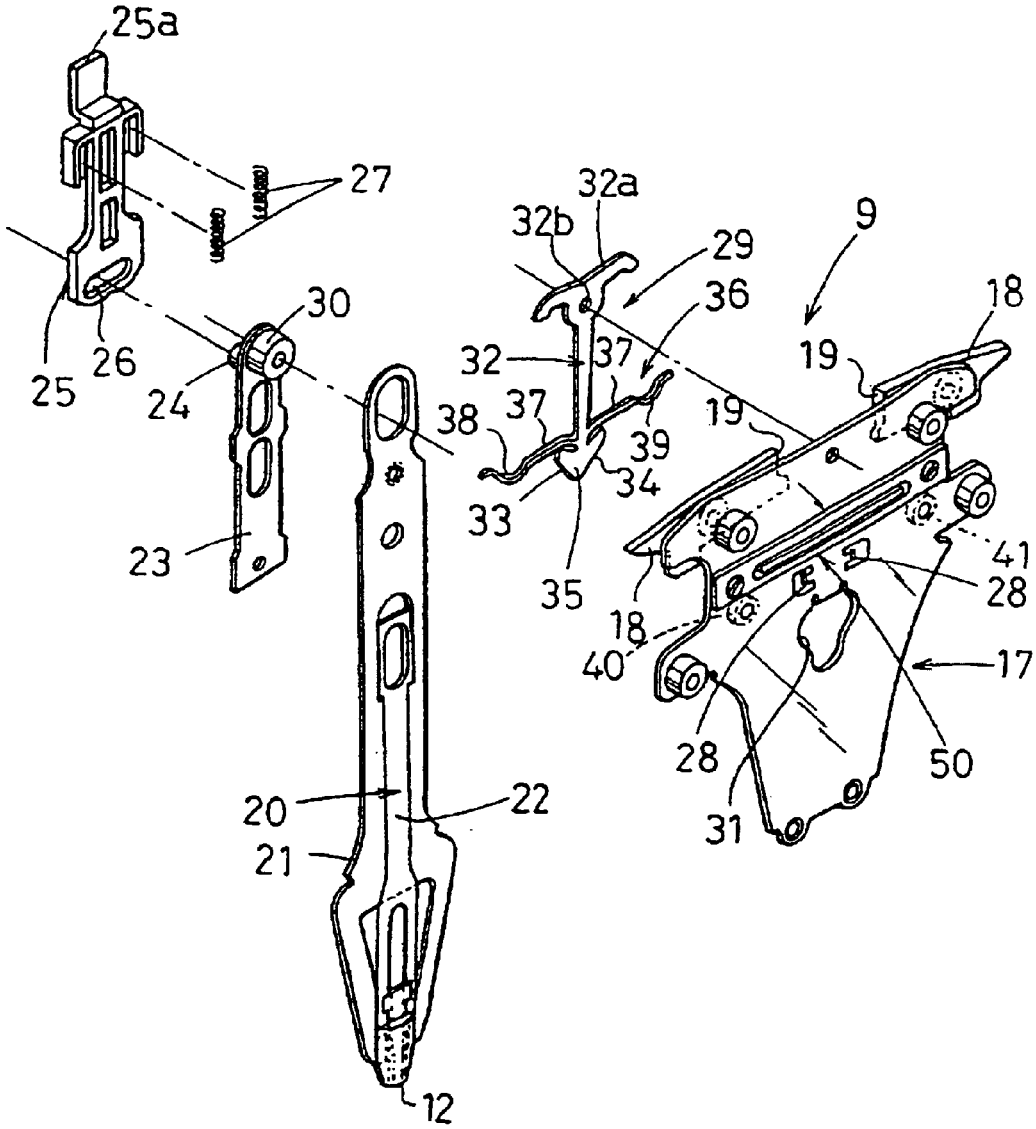
FIG. 4 is an exploded perspective view of the yarn feeder portion of the present invention.

As shown in FIGS. 3 and 4, the regulation hole 31 is formed in an approximately trifoliate shape having spaces, with which switching roller 30 is engaged, at upper, right, and left portions thereof.

The selection lever 32, which sets an upward moving direction of the switching roller 30 confronting the regulation hole 31, is formed in an approximately T-shape with its upper end portion 32*a* formed in a gentle V-shape. The selection lever 32 is pivoted to the feeder case 17 at a pivot portion 32*b* at a center as well as lower portion thereof, which hangs down from a central portion of the upper end portion 32*a* and terminates in an arrow shape having inclined surfaces 33 and 34 on right and left sides thereof for directing the upward moving direction of the switching roller 30.

Further, a holding member 36, which holds two switching attitudes of the selection lever 32, is disposed at an upper portion of an arrow-shaped portion 35 composed of the two inclined surfaces 33 and 34.

The holding member 36 is arranged such that mustache-shaped elastic portions 37 are extended right and left from an upper portion of the arrow-shaped portion 35, and wrapping portions 38 and 39 are formed by curving portions near extreme ends of the elastic portions, and engaging projections 40 and 41 are formed on a back surface of the feeder case 17 so that they are engaged with any one of the wrapping portions 38 and 39 when the selection lever 32 is swung right or left.

The push-down device 13 for pushing down the feeder rod 20 is composed of a coupling plate 42 whose one end is coupled with the bringing pin 14 at an intermediate height position thereof and a cam plate 43 whose upper end portion is coupled with another end of the coupling plate 42. With the push-down device 13 arranged as described above, the cam plate 43 is swung back and forth about a swing pivot pin 44 in association with up/down movement of the bringing pin 14.

As shown in FIG. 3, the cam plate 43 has a lower side portion formed flat and both ends formed in an inclined state, and the bringing pin 14 is disposed on a knitting yarn guide rail side at a central position of this flat lower side portion.

Note that reference numeral 50 in FIG. 4 denotes a brake unit composed of a magnet attracted to the knitting yarn guide rail. Since the yarn feeder 9 is reduced in size and weight, the yarn feeder 9 can be stopped at an accurate position even by a light sliding friction generated by an attracting force of the magnet. Accordingly, there does not arise such a problem caused in a conventional yarn feeder that when a yarn feeder being brought is to be stopped, it cannot be stopped at a desired position because a stop position of it is made unstable by a large inertia force thereof, and it is not necessary to provide a special brake unit for stopping the yarn feeder at the desired position by overcoming the large inertia force thereof.

Next, operation of the yarn feeding apparatus when a fabric is knitted will be described.

When the carriages 6 are caused to travel on the needle beds 3, for example, from right to left (direction shown by an arrow A in FIGS. 3 and 5) by the belt drive device in response to a signal from the controller, the knitting needles 5 disposed in parallel with each other on the needle beds 3 are advanced and retreated by the knitting cams 7.

When the carriages 6 travel, in a portion where no knitting is executed, a solenoid is actuated in response to an output signal for knitting a pattern so that the output shaft of the solenoid is projected downward, thereby the bringing pin 14 of bringing device 10 is moved upward against tension of a spring 16 through a transmission rod 15.

As the bringing pin 14 is moved upward, the cam plate 43 of a push-down device 13 is lifted up about a swing pivot pin 44 (refer to the cam plate 43 on the right side in FIG. 2).

Then, at a portion where knitting is executed, a solenoid is actuated in response to a signal output from the controller at a position in front of a position where a carriage 6 confronts a predetermined yarn feeder 9 for supplying yarn to knitting needles 5, and when the output shaft of the solenoid is retreated upward, the bringing pin 14 moved upward heretofore is pushed downward by tension of another spring 16. In association with this pushed-down operation of the bringing pin 14, the cam plate 43 of another push-down device 13 is swung toward a yarn feeder side about a swing pivot pin 44 through a coupling plate 42 (refer to the cam plate 43 on the left side of FIG. 2).

Figure 5:
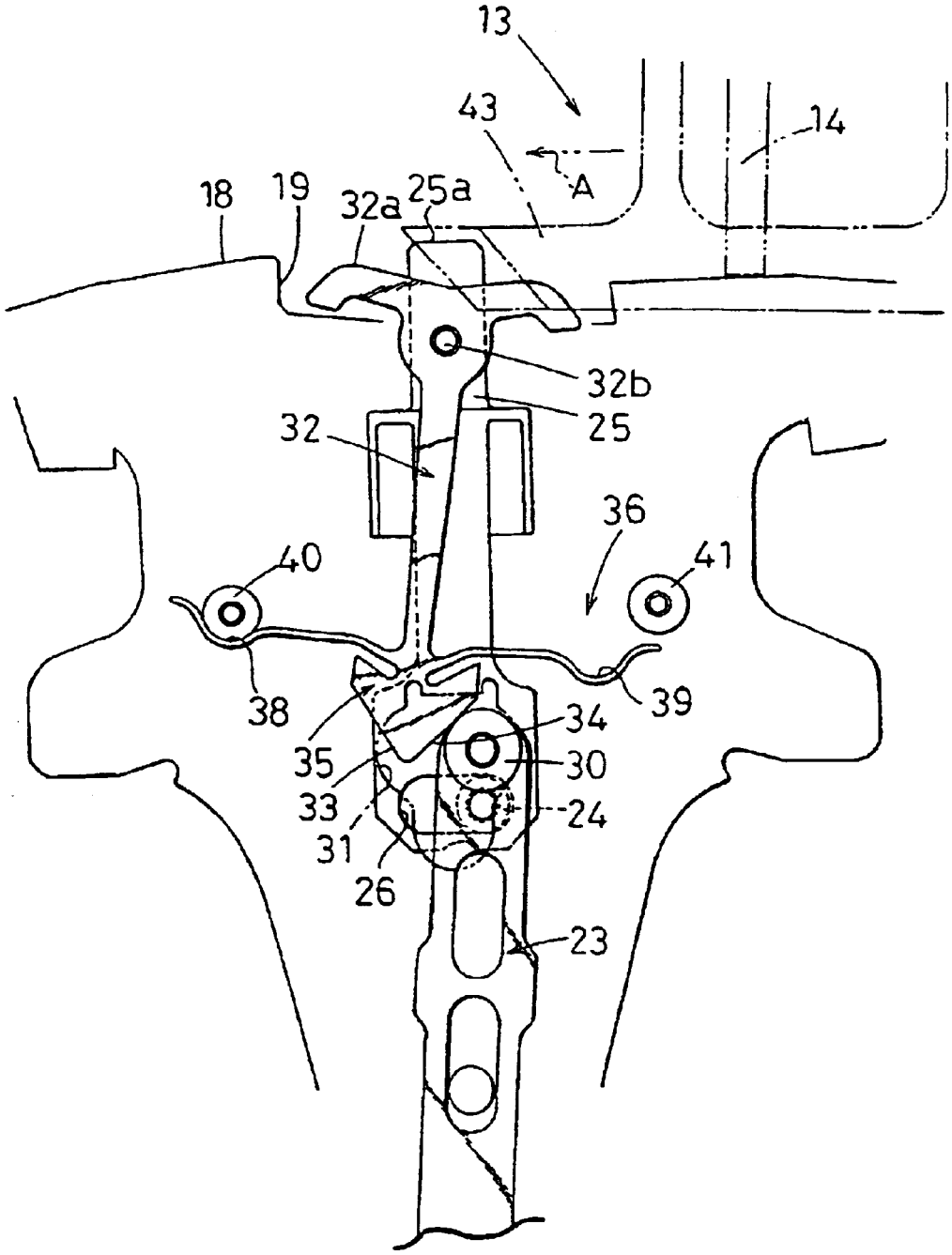
FIG. 5 is a view explaining an operation of a selection lever in the yarn feeder of the present invention.
Figure 6:
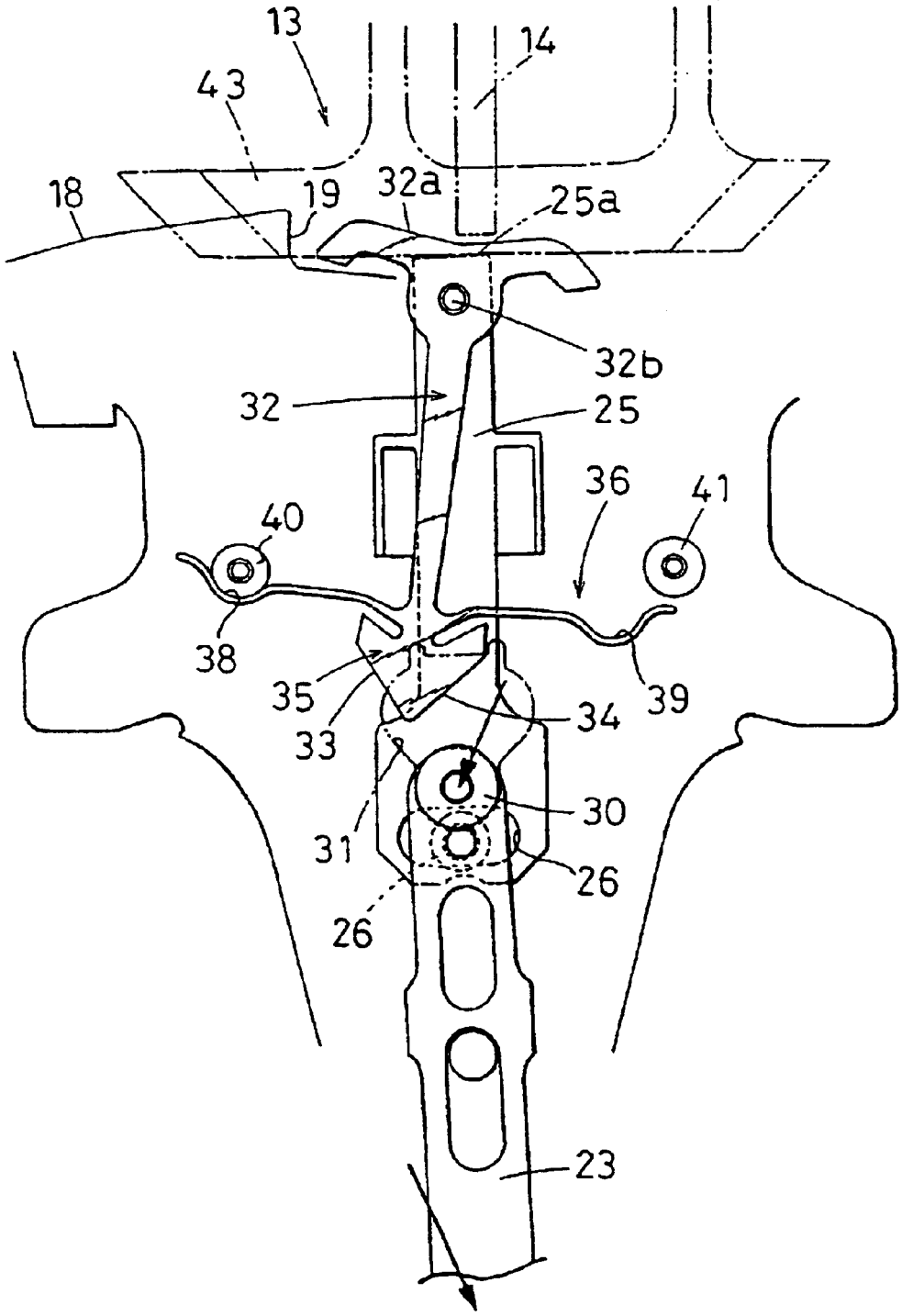
FIG. 6 is a view explaining an operation of the selection lever in the yarn feeder of the present invention.

When the carriage 6 slides and the cam plate 43 pushes down the upper end portion 25*a* of an upper plate 25 against an urging force of a coil spring 27, the switching roller 30 confronting the regulation hole 31 is placed in a state as shown in FIG. 6 in such a manner that it is guided and lowered to a central lower portion of the regulation hole 31 from the state shown in FIG. 5.

As the switching roller 30 is guided and lowered to the central lower portion of the regulation hole 31, the feeder rod guide 21 stands upright at a central portion of the feeder case 17 while projecting the yarn feeding port 12 of the feeder rod 20 downward from a lower end of the feeder rod guide 21, and the yarn feeding port 12 is located at a yarn feed position near the knitting needles 5 on a needle bed 3.

Figure 7:
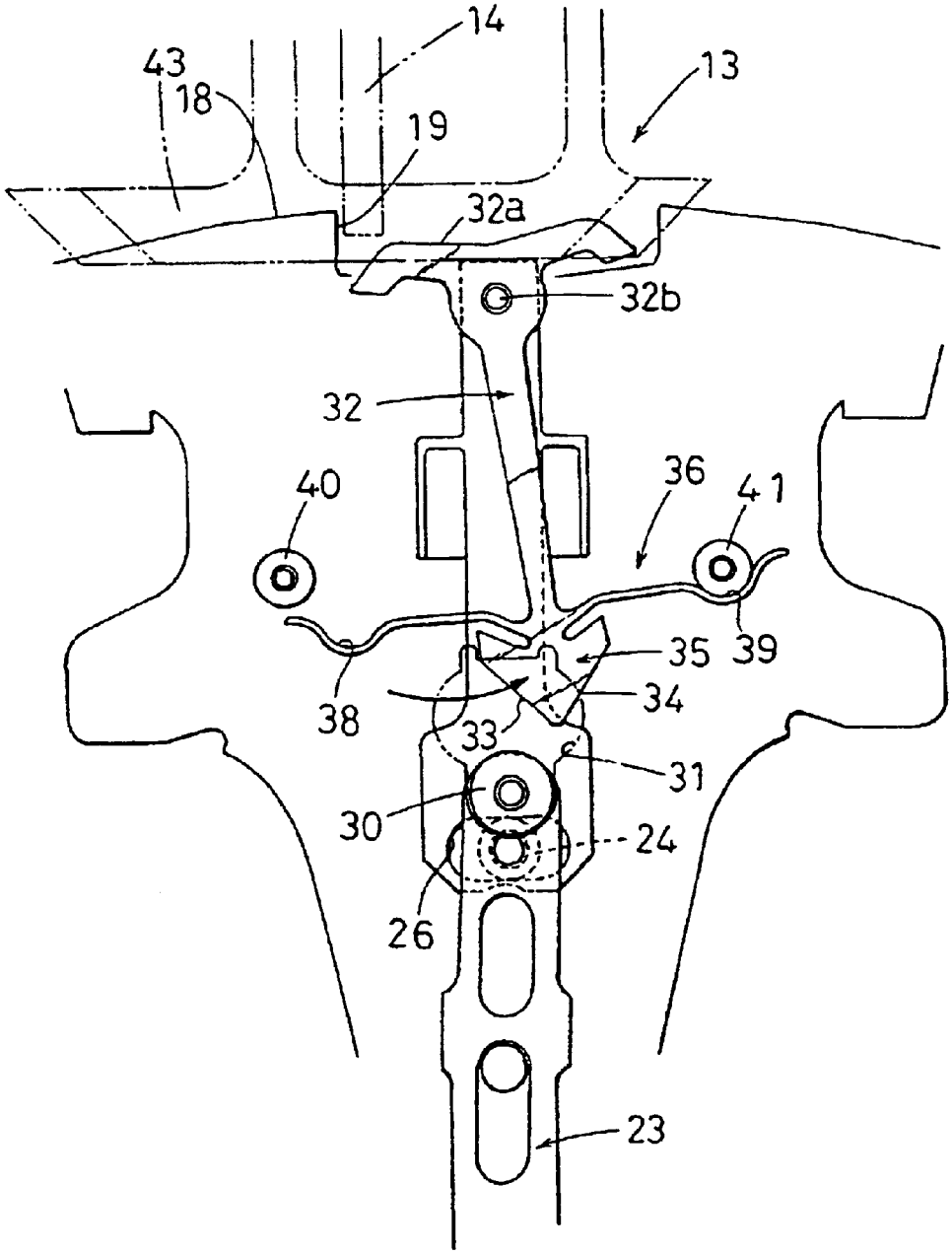
FIG. 7 is a view explaining an operation of the selection lever in the yarn feeder of the present invention.

When the carriages 6 further travel leftward and the bringing pin 14 presses a projecting upper end portion 32*a* on a lower part (left side) of the selection lever 32, the selection lever 32 is swung counterclockwise about the pivot portion 32*b* acting as a center of rotation as shown in FIG. 7. An attitude of the selection lever 32 is held because the left wrapping portion 38, which forms a holding member 36, of the elastic portion 37 of the selection lever 32 is disengaged from engaging projection 40, and because the right wrapping portion 39 is engaged with engaging projection 41.

Thereafter, when the bringing pin 14 is abutted against the engaging portion 19 of a swinging piece 18 located downstream of an advancing direction of the selection lever 32, the yarn feeder 9 is brought by the carriage 6, and yarn is fed to the knitting needles 5 from the yam feeding port 12 of the yarn feeder 9, whereby a knitting portion is knitted with yarn fed from the yarn feeder 9.

When the knitting portion has been knitted, the solenoid is energized in response to a signal output from the controller, the output shaft of the solenoid is projected downward, and the bringing pin 14 moved downward heretofore is pushed upward against tension of the spring 16. As the bringing pin 14 is moved upward, the cam plate 43 of the push-down device 13 is swung by being lifted up about the swing pivot pin 44.

When the bringing pin 14 is moved upward and disengaged from the engaging portion 19 of the swinging piece 18 located downward of an advancing direction of the carriage 6, the yarn feeder 9 is released. In addition, since the cam plate 43 is lifted up and swung, the feeder rod 20 pushed down heretofore is pushed upward by the coil spring 27 to a position where the feeder port 12 at a lower end thereof does not interfere with the yarn feeding port 12 of another yarn feeder 9, knitting needles 5, sinkers and the like.

Figure 8:
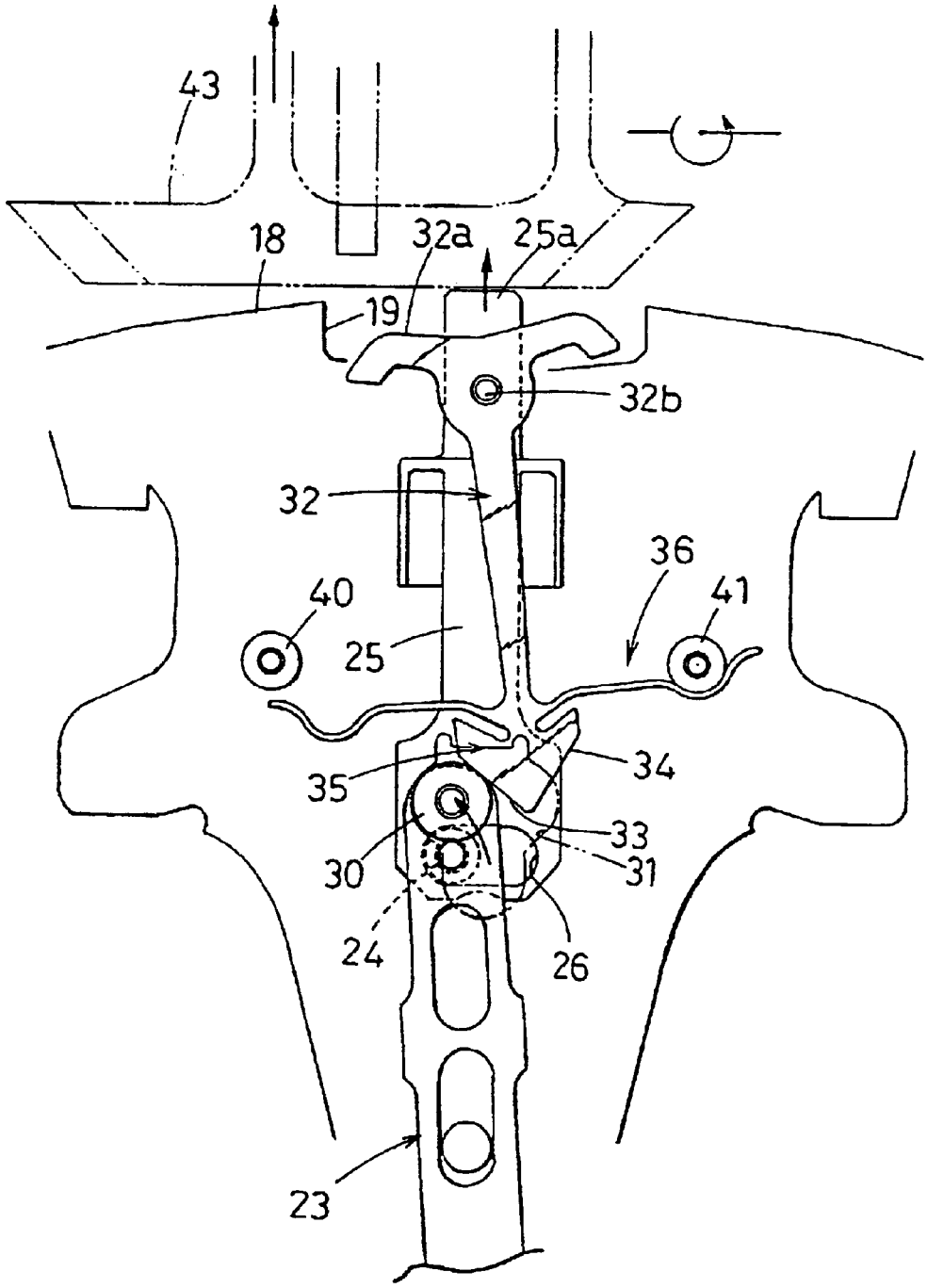
FIG. 8 is a view explaining an operation of the selection lever in the yarn feeder of the present invention.

When the feeder rod 20 is pushed upward by the coil spring 27, the selection lever 32 is already switched in a counterclockwise direction. Accordingly, when the switching roller 30 is moved upward, it is moved upwardly left by being guided by the left inclining surface 33 of the selection lever 32 as shown in FIG. 8. As a result, the yarn feeding port 12 is moved upward in a state that it is swung right together with the feeder rod guide 21.

Next, when the carriage 6 arrives at a predetermined position where knitting yarn is changed, a solenoid is actuated for another yarn feeder 9 to be changed in response to a signal output from the controller similarly to the operation described above, the output shaft of this solenoid is retreated upward, the bringing pin 14 moved upward heretofore is pushed downward by tension of the spring 27 and the cam plate 43 of the push-down device 13 is swung to the yarn feeder side about the swing pivot pin 44.

After the bringing pin 14 is moved downward, fabric is knitted with knitting yarn fed from the yarn feeding port 12 of a yarn feeder 9 selected by the same procedure as that described above.

It should be noted that although the above embodiment explains a case that the carriages 6 are caused to travel on the needle beds 3 from right to left by the belt drive device, knitting can be executed similarly when the carriages 6 travel thereon from left to right.

Figure 9:
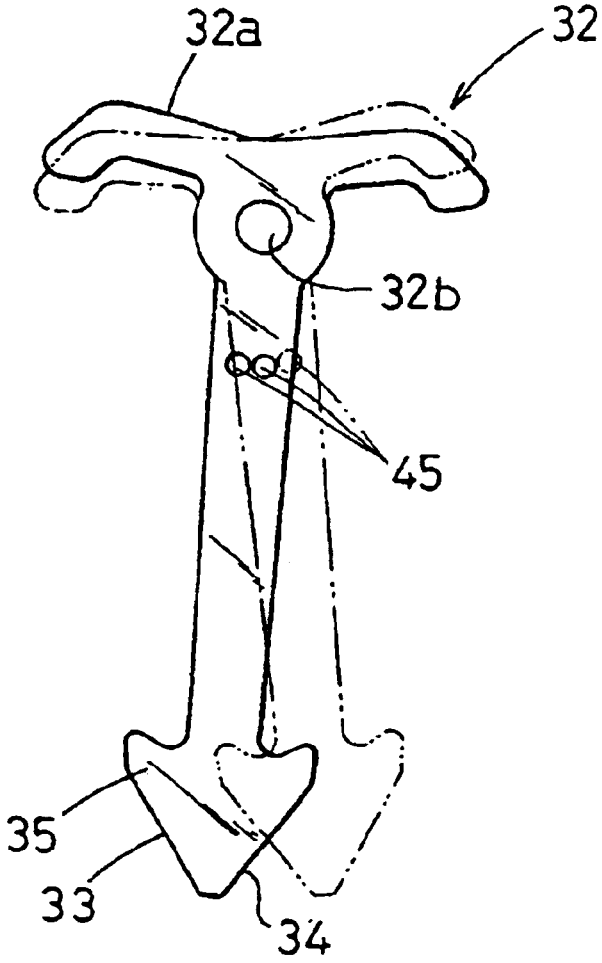
FIG. 9 is a front elevational view showing a modification of the selection lever in the yarn feeder of the present invention.

Further, in the above embodiment, the holding member 36 is arranged such that the mustache-shaped elastic portions 37 extend from an upper portion of the arrow-shaped portion 35 right and left, the wrapping portions 38 and 39 are formed by curving portions of the elastic portions 37 near extreme ends thereof, and the engaging projections 40 and 41, which are engaged with any of the wrapping portions 38 and 39 when the selection lever 32 is swung right or left are disposed on the back surface of the feeder case 17. However, the holding member 36 is not limited to the above arrangement and may be arranged, for example, such that plural recesses or holes 45 are formed at a portion of the selection lever 32 as shown in FIG. 9, and a ball or a pin (not shown), which is engaged with the recesses or the holes 45, is urged on an engagement side by a spring.

Figure 10:
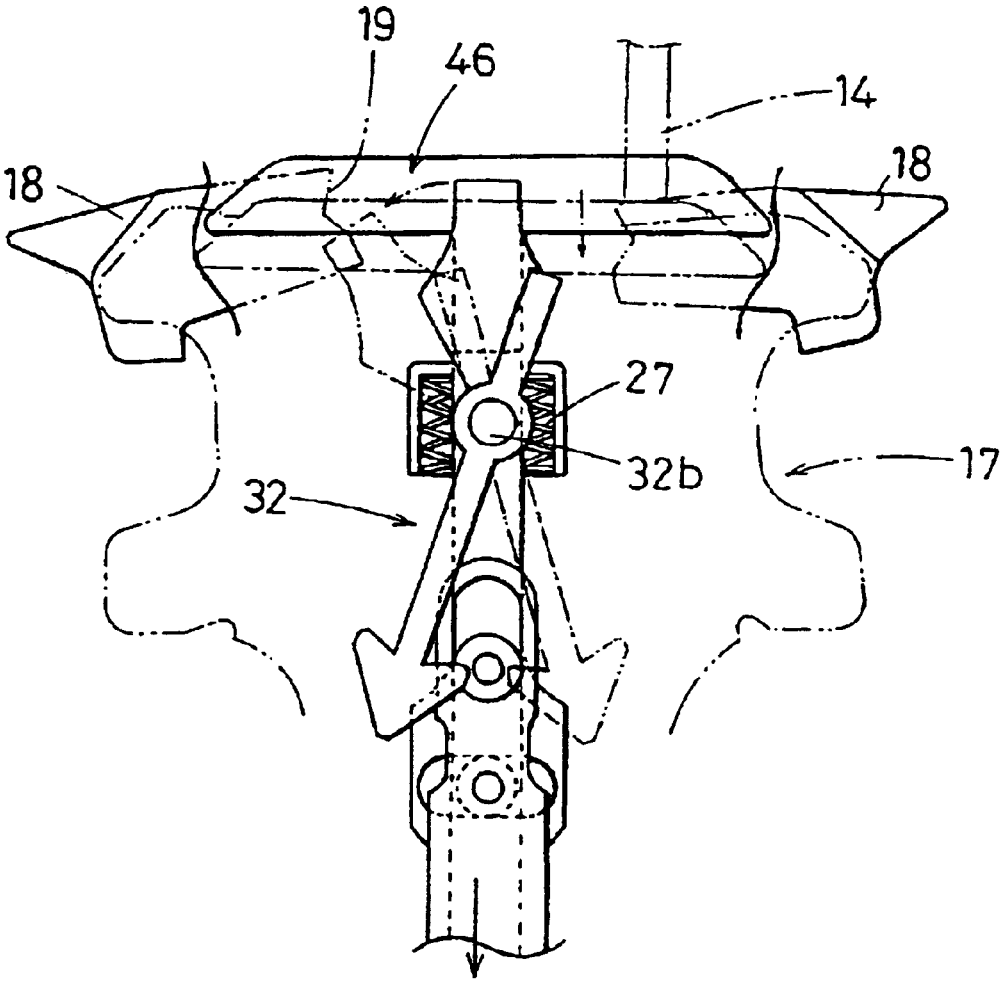
FIG. 10 is a front elevational view showing a modification of a push-down mechanism in the yarn feeder of the present invention.
Figure 11:
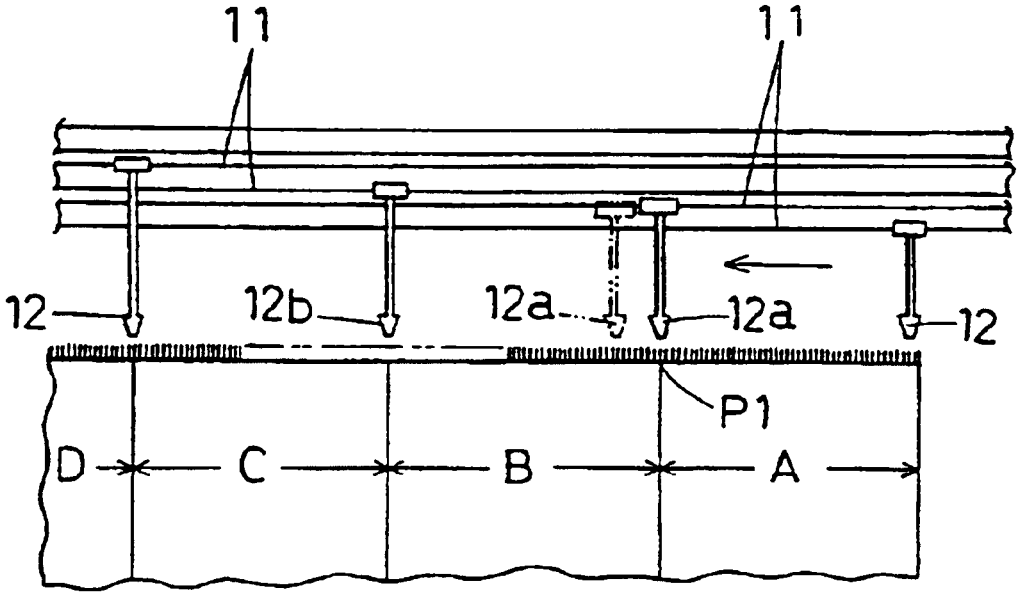
FIG. 11 is a view explaining a knitting course in a conventional knitting of an intersia pattern.

Further, in the above embodiment, the push-down device 13 is composed of the coupling plate 42 whose one end is coupled with the bringing pin 14 at an intermediate height position thereof and the cam plate 43 whose upper end portion is coupled with another end portion of the coupling plate 42, and the cam plate 43 is swung back and forth about the swing pivot pin 44 in association with upward/downward movement of the bringing pin 14. However, the push-down device 13 may be altered as shown in, for example, FIG. 10.

That is, a receiving piece 46, which is formed by upsetting the cam plate 43 of the above embodiment, is disposed at an upper end portion of the feeder rod as well, and a receiving piece is pushed downward and the selection lever 32 is switched by traveling about the bringing pin 14.

INDUSTRIAL APPLICABILITY

As described above, in the yarn feeders for the flat knitting machine according to the present invention have feeder case portions, which are slidably engaged with a knitting yarn guide rail disposed at an upper portion of needle beds and can be selectively brought by a bringing device, and the feeder cases each of which is provided with a switching mechanism for switching yarn feeding ports between a feeding position and a waiting position, wherein the switching mechanism has the yarn feeding port and the two waiting positions, i.e. a first waiting position and a second waiting position located across the yarn feeding port, the switching mechanism is operated at a time during which a yarn feeder selected by the bringing device is brought from a stop state in order to feed yarn, the yarn feeding port is switched from the first waiting position to the yarn feeding position, the swinging direction, in which the yarn feeding port is swung to the second waiting position after it feeds the yarn, is set, and the yarn feeding port can be switched from the feeding position to the second waiting position in association with a selection cancel operation of the bringing device after it feeds the yarn.

With the above arrangement, a sliding distance of the bringing device, which is required to execute a series of operations for switching the yarn feeding port of the yarn feeder from the waiting position to the feeding position, bringing the yarn feeder, and switching the yarn feeder port of the yarn feeder from the feeding position to the waiting position inward of a knitted fabric region knitted, can be shortened, and hence an increase in size of portions of the yarn feeders actuated by the bringing device can be prevented.

Since an increase in size of the yarn feeders can be prevented, an increase in weight of the yarn feeders can also be prevented. As a result, there can be also obtained advantages in that even if the bringing device brings the yarn feeders at a high speed, a shock caused in this process can be reduced, thereby the apparatus need not be reinforced in its entirety and durability of the apparatus can be improved.

What is claimed is:

1. A yarn feeder for a flat knitting machine, comprising:

a feeder case that is slidably engaged with a guide rail disposed at an upper portion of a needle bed, and movable toward the needle bed via operation of a bringing device; and a yarn feeding port associated with said feeder case, said yarn feeding port capable of being positioned in a yarn feeding position and first and second waiting positions on opposite sides of the yarn feeding position, and said yarn feeding port capable of being swung between the yarn feeding position and the first and second waiting positions via operation of a switching mechanism, wherein the switching mechanism is constructed and arranged to (i) swing said yarn feeding port from the first waiting position to the yarn feeding position at a time during which said feeder case starts to be moved, via operation of the bringing device, from a stop state toward the needle bed, and set a swinging direction such that said yarn feeding port is swung from the yarn feeding position to the second waiting position after yarn is fed from said yarn feeding port, and (ii) swing said yarn feeding port from the yarn feeding position to the second waiting position in association with a selection cancellation operation, of said yarn feeder, as executed by the bringing device after yarn has been fed.

2. The yarn feeder according to claim 1, further comprising:

a feeder rod supported by said feeder case, at an intermediate portion of said feeder rod, for linear movement toward and away from the needle bed and for pivotal movement, with said yarn feeding port being at a lower end of said feeder rod such that pivotal movement of said feeder rod results in said yarn feeding port swinging between the yarn feeding position and the first and second waiting positions;

a swing operating portion at the intermediate portion of said feeder rod;

a push-down operating portion, at an upper end of said feeder rod, for moving said yarn feeder port to the yarn feeding position against an urging force; and a setting unit for setting a direction in which said swing operating portion is to be moved toward and away from the needle bed, wherein the switching mechanism is also constructed and arranged to switch the direction in which said swing operating portion is to move, toward and away from the needle bed, when said feeder rod is moved to position said yarn feeding port at the yarn feeding position.

* * * * *